United States Patent [19]

Brunner

[11] Patent Number: 4,753,020

[45] Date of Patent: Jun. 28, 1988

[54] DRYER FOR WOOD

[75] Inventor: Reinhard Brunner, Gehrden, Fed. Rep. of Germany

[73] Assignee: Hilderbrand Holztechnik GmbH, Oberboihingen, Fed. Rep. of Germany

[21] Appl. No.: 754,273

[22] Filed: Jul. 12, 1985

[30] Foreign Application Priority Data

Jul. 12, 1984 [DE] Fed. Rep. of Germany ..... 3425642
Dec. 1, 1984 [DE] Fed. Rep. of Germany ..... 3443915

[51] Int. Cl.[4] ..... F26B 21/00
[52] U.S. Cl. ..... 34/196; 34/210; 34/223; 34/230; 34/231
[58] Field of Search ..... 34/191, 209, 210, 215, 34/218, 230, 231, 223, 196

[56] References Cited

U.S. PATENT DOCUMENTS

| | | | |
|---|---|---|---|
| 1,513,597 | 10/1924 | Judelson | 34/209 |
| 1,737,068 | 11/1929 | Younger | 34/212 |
| 1,840,523 | 1/1932 | Mueller | 34/191 |
| 2,347,601 | 4/1944 | Jackson | 34/191 |
| 3,659,352 | 5/1972 | Cook | 34/191 |
| 4,014,107 | 3/1977 | Bachrich | 34/196 |

FOREIGN PATENT DOCUMENTS

| | | | |
|---|---|---|---|
| 1234356 | 10/1960 | France | 34/215 |
| 1010422 | 4/1983 | U.S.S.R. | 34/210 |

OTHER PUBLICATIONS

Brochure entitled "Energy Saving System HD 85 E".

*Primary Examiner*—Albert J. Makay
*Assistant Examiner*—David W. Westphal
*Attorney, Agent, or Firm*—Roylance, Abrams, Berdo & Goodman

[57] ABSTRACT

A dryer, especially for wood, has at least two drying chambers separated from each other by at least one partition wall, at least one fan in each of the drying chambers, and at least two connection passages for the reciprocal connection of the drying chambers. Each of the connection passages can be constricted or blocked off by blocking devices. To properly convey drying agent to where it is to be used, a fan is mounted in at least one of the drying chambers connected together by the connection passages, is associated with one connection passage, and is arranged directly adjacent to the connection passage. The blocking device includes a flap on one side only. When the flap is closed, it forms a part of the side wall of one connection passage. The flap is arranged directly in front of and in the conveying direction of the fan, such that, when it is open, it forms a deflector for the drying agent conveyed by the fan.

3 Claims, 4 Drawing Sheets

COMPUTER
THERMOSTAT

A
B
C
II
III
THERMOSTAT
THERMOSTAT

I
I

DRYER FOR WOOD

FIELD OF THE INVENTION

The present invention relates to a dryer with a plurality of drying chambers selectively connected in fluid communication by connection passages and with fans conveying the drying agent through the drying chambers and connection passages.

SUMMARY OF THE INVENTION

An object of the present invention is to provide a dryer with a plurality of drying chambers wherein the drying agent can be selectively conveyed from one drying chamber into another drying chamber to save energy.

Another object of the present invention is to provide an arrangement for selectively conveying drying agent between the drying chambers of a multiple chamber dryer which is relatively small, and can be easily and inexpensively added to existing dryers.

The foregoing objects can be obtained by a dryer, comprising first and second drying chambers separated by a partition wall, first and second connection passages extending through the drying chambers and providing selective reciprocal fluid communication between the drying chambers, closure flaps and fans located in the drying chambers. Each connection passage has a port opening into each of the drying chambers. The closure flaps are associated with the ports and are selectively movable between open positions spaced from the ports and closed positions closing the ports. The fans are adjacent to the flaps such that the flaps in their open positions deflect the drying agent conveyed by the fans.

The drying agent can be conveyed directly from one of the drying chambers into another drying chamber. The fans circulate the drying agent from one drying chamber into the other drying chamber so that the drying agent can circulate within the specific drying chamber.

A radiator in one of the drying chambers can heat the drying agent conveyed into the other drying chamber. In the other drying chamber, the radiator can be uncoupled from the heating circuit or can be supplied with less heat. The connection passages require considerably smaller space and can be constructed at relatively low cost in existing drying chambers.

The connection passages can be spaced from the horizontal planes in which the fans are located. In a simple manner, this permits the connection passages to be constructed as wide as needed without being too high. The effective degree of heat exchange, without moisture transfer, is increased by the size of the partition between the connection passage and the drying chamber, which partition is momentarily not participating in the direct drying agent exchange. The drying agent in the drying chamber is significantly moistened by condensation on passage walls. The cool drying agent, e.g. fresh air, conducted through the passage, absorbs accumulating condensation heat. The common surface of the drying chamber and the connection passages is quite large. There are only slight structural differences between lengthwise and transverse arranged drying chambers.

The vertical spacing of the connection passages and fans provides a simple and integral construction of the connection passages for transverse and lengthwise arranged drying chambers, without preventing the drying agent circulation. The connection passages lie completely outside the drying agent flow required for circulation.

The cover of the drying chambers can also form the top wall of the connection passages. The connection passage side walls can be formed partially by the side walls of the drying chamber.

For conveying the drying agent, especially air, a plurality of fans can be arranged next to one another. When the flaps are open, the flaps are pressed by the dynamic pressure of the fans against mechanical end stops. The need for a clamping device or an increase in the holding torque of the control motors for the flaps when the associated fans are in a suction mode is obviated by suspending the flaps from above. In this manner, the flaps remain open as a result of their specific weight.

Locating the first connection passage over the second connection passage and separating the connection passages with a common horizontal partition provides the important advantage of a quite extensive heat exchange surface between the two connection passages. Since only one of the two passages is in direct heat contact with the drying agent in the drying chamber, the air of one temporarily nonparticipating chamber can be heated through the bottom connection passage, and moisture can be extracted by condensation on the bottom of the bottom passage or left alone.

Making the flap width greater than the chamber of the adjacent fan has the advantage of providing a higher flow velocity to the drying agent in the connection passage. Additionally, higher moisture extraction capacity by condensation, a more rapid drying agent exchange, and an improved mixing of the drying agent in the drying chamber are obtained. The flaps can have a width permitting two or more fans to be associated with one flap.

Separating the connection passages with an obliquely extending partition permits increased heat exchange between the connection passages. When one passage surface, considering the entire surfaces of both passages adjacent to the fans, is narrower than the other passage surface, allowance can be made for an air hose connector such that only one of the connection passages is in constant heat contact with the drying agent of the drying chamber.

The mechanical connection of the connection passages with the chamber cover and/or the outside chamber walls increases the static strength of the drying chamber and reduces costs by saving material. The mechanical connection of the connection passages with an intermediate ceiling can entirely or partially replace the suspension arrangement for the intermediate ceiling. Use of a drying chamber wall for a wall of the connection passages also saves materials.

Preferably, only two connection passages are provided with a suitable arrangement of the flaps (i.e., symmetrical relative to the fan plane). Considering the control and drying technology of all reversible fans of one chamber having one common direction of conveyance, the number of possible drying agent exchange reactions is unlimited. Outgoing air can be conducted from any one of the drying chambers, independently of the other drying chambers, into one of the two connection passages. Incoming air can be simultaneously conducted out of the other connection passage. Each of the drying chambers can be selectively coupled for outgoing air and for incoming air.

With outside air flaps connecting the passages with the outside atmosphere and having controllable opening angles, the conventional air flaps in the outside walls of the drying chambers can be deleted. The control devices for the flaps are simplified. With the drying agent exchange between the separate chambers passing through the connection passages, fresh air can be mixed in, and a part of the drying agent can be carried out of at least one of the chambers into the atmosphere. The conventional exchange of drying agent between any one chamber and outside air is likewise possible.

Using an outside thermostat to control the outer flaps satisfies the otherwise costly and imprecise burden for controlling the outer or outside air flaps. With a computer controlling the process and relating the process to the outside atmospheric conditions, the suitable theoretical values for the opening angle of the outside air flaps during air exchange of the various chambers can be calculated and optimized.

The thermostatic control of the outside air flaps further optimizes the conventional theoretical values for the atmosphere within the chambers during a drying operation relative to total energy use dependent in time upon the heat available, heat and power costs, the drying time (length of use of the chamber and amortization to be considered, etc.), quality of drying, and so forth.

Using highly heat conductive material for the partition between the connection passages permits energy to be recovered by heat exchange from the drying agent being discharged. With the condensation of air humidity, a part of the vaporization energy is recovered. The liquid condensate is discharged to the outside.

With a heat exchanger constructed as a radiator, the ingoing air connection passage for one drying chamber, which ingoing air is a desired mixture of fresh air and outgoing air from other chambers, can be heated before it reaches the chamber, if necessary. The heat exchanger can also be associated with a heat pump.

With at least one atmosphere control point in each of the two passages, the heat capacity of the additional radiator can be suitably dosed or controlled by a simple servomechanism. Direct moisture measurement of a desired mixture, contained in the passages of the outgoing air from different chamber and fresh air, simplifies the program for controlling the flaps.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE EMBODIMENTS

Figure 1:
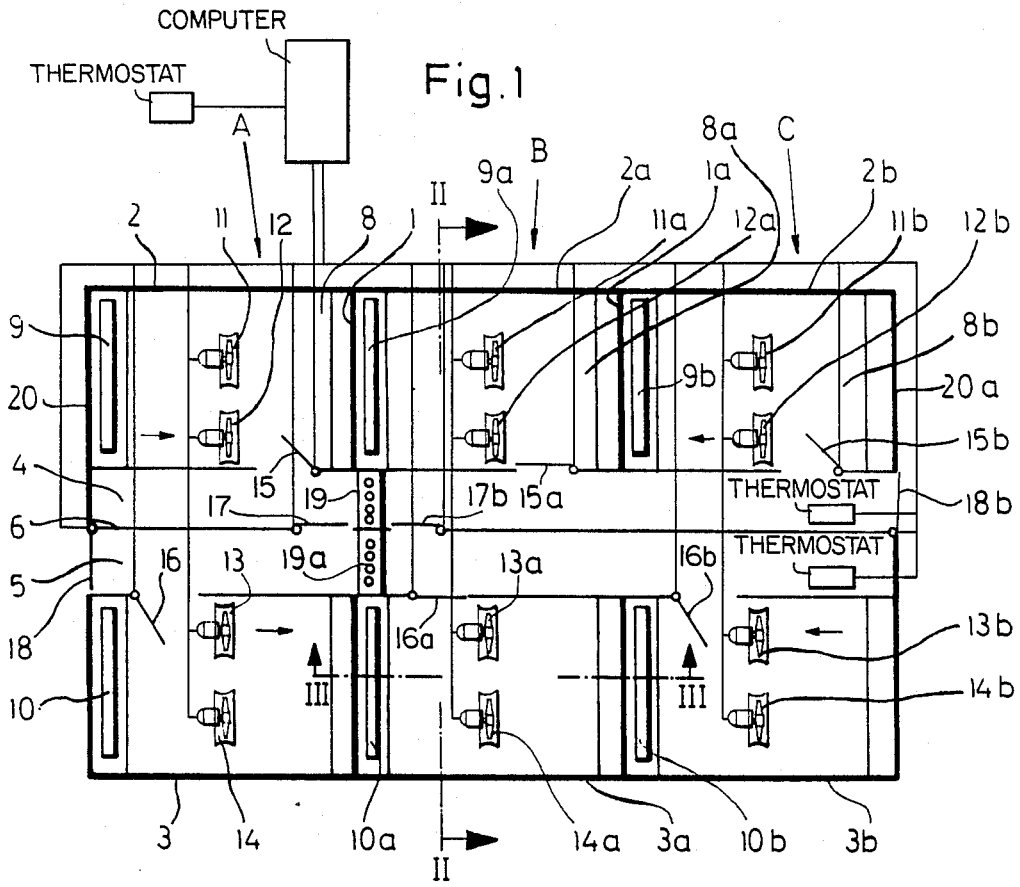
FIG. 1 is a diagrammatic top plan view in section of a dryer according to a first embodiment of the present invention, taken along line I—I of FIG. 2.
Figure 2:
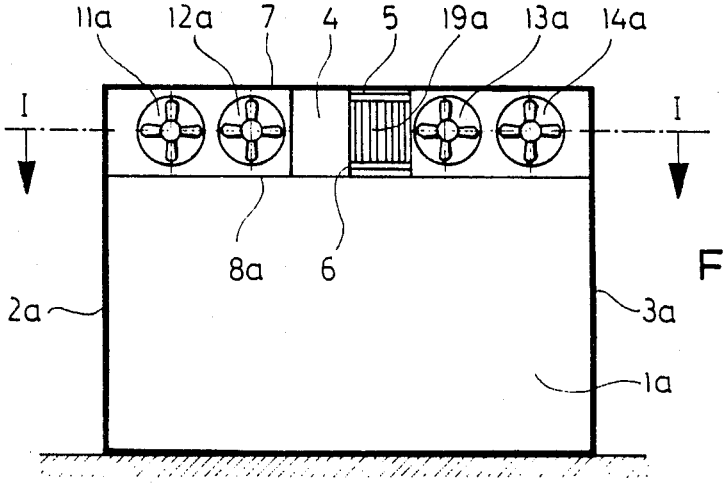
FIG. 2 is a diagrammatic front elevational view in section taken along line II—II of FIG. 1.
Figure 3:
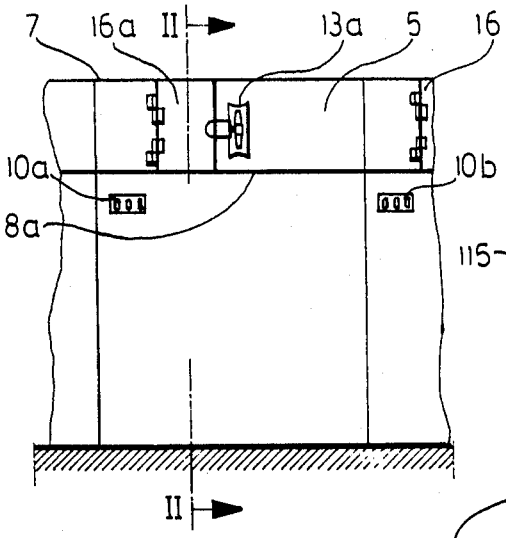
FIG. 3 is a diagrammatic side elevational view in section taken along line III—III of FIG. 1.

Referring initially to FIGS. 1–3, three identical drying chambers A, B and C are arranged directly adjacent to each other. Chambers A and B are separated by a common partition 1, while chambers B and C are separated by a common partition 1*a*. Drying chambers A, B and C comprise side walls 2, 3 and 2*a*, 3*a* and 2*b*, 3*b*, and two front walls 20 and 20*a*.

The three drying chambers A, B and C are connected together by two rectangular connection passages 4 and 5. The connection passages are each rectangular in transverse cross section, have a common intermediate partition 6, and are limited at the top by cover 7 over drying chambers A, B and C and at the bottom by intermediate ceilings 8 and 8*a* arranged within the drying chambers so that special passage walls are not required at these points.

The outside walls of connection passages 4 and 5 preferably form a quadrate when viewed in transverse cross section. Intermediate ceilings 8, 8*a* and 8*b* are smaller than the respective chambers to allow drying agent circulation in each of the chambers. Intermediate partition 6 can be of a material which conducts heat well and can be provided with heat transmitting ribs.

Two radiators 9 and 10 and four fans 11 to 14, each of which can be rotated, and arranged in one plane, are associated with chamber A. The two inside fans 12 and 13 are directly adjacent to the respective connection passages 4 and 5. Chambers B and C are of identical configuration. The identical parts of chambers B and C are labeled a and b, respectively. The arrows associated with fans 12, 12*b*, 13 and 13*b* indicate the temporary direction of rotation for each fan.

Connection passage 4 has rectangular flaps 15, 15*a* and 15*b* on its side facing fans 12, 12*a* and 12*b*. The breadth or width of the flaps corresponds approximately to the diameter of the associated fan, but is at least 0.5 times greater than the fan's diameter. The flaps are movable into open positions, as flaps 15 and 15*b*, so that the drying agent is conveyed by fan 12 from chamber A into connection passage 4. By means of fan 12*b*, drying agent is then conveyed from connection passage 4 into drying chamber C. The flaps can also move to a closed position, as flap 15*a*.

Passage 5 likewise has flaps 16, 16*a* and 16*b* associated with fans 13, 13*a* and 13*b*, respectively. Flaps 16 and 16*b* are open, while flap 16*a* is closed, so that the drying agent is conveyed from drying chamber C by fan 13*b* into connection passage 5 and then is conveyed by fan 13 from connection passage 5 into drying chamber A. With the illustrated positions of flaps 15, 15*a* and 15*b*, and 16, 16*a* and 16*b*, one of the fans 12, 12*a*, 12*b* and 13, 13*a*, 13*b* is sufficient for conveying drying agent between chambers A and C in this manner.

Flaps 17 and 17*b* can be provided in intermediate partition 6 in the area of drying chamber A and B for connecting connection passages 4 and 5. Connection passage 5 can be closed on front wall 20 by an outside air flap 18, or can be connected with the outside atmosphere when flap 18 is opened. Connection passage 4 can be closed on the wall 20*a* or can be vented to the atmosphere flap 18*b*.

A radiator 19 is provided in connection passage 5. If connection passages 4 and 5 are ingoing air and outgoing air passages, then, with condensation of air humidity on intermediate partition 6, radiators 19, 19*a* can be rather small measured. Both radiators 19 and 19*a* preferably lie in one plane and in the same plane with one of the radiators 9*a* and 9*b*, or one of the partitions 1 and 1a. Flaps 17 and 17*b* are directly adjacent to radiators 19 and 19*a*. The pivot axes of flaps 17 and 17*b* are at the ends of the flaps remote from radiators 19 and 19*a*. One of the radiators 19 and 19*a* can also be a heat exchanger for a heat pump.

Intermediate partition 6 can be flat or structured, i.e. corrugated, ribbed or the like.

Fans 11 to 14, 11*a* to 14*a*, and 11*b* to 14*b*, and flaps 15, 15*a*, 15*b*, 16, 16*a*, 16*b*, 17, 17*a*, 17*b* and 18, 18*b* are controlled by control device corresponding to the drying program for wood panels in drying chambers A, B and C. The same is true regarding the control of radiators 9, 9*a*, 9*b*, 10, 10*a*, 10*b*, 19 and 19*a*.

In the first embodiment, each of the fans 12, 12*a*, 12*b* and 13, 13*a* and 13*b* associated with connection passages 4, 5 is also associated with a flap 15, 15*a* and 15*b*, and 16, 16*a* and 16*b*, respectively. It is also possible to use two essentially identically dimensioned flaps with one flap on each side of each of these fans. The flaps associated with one of the fans are then separated from each other by the fan plane. At least one of the flaps associated with each fan is closed.

Advantageously, the dryer is controlled by a computer. The decision whether one of the drying chambers A, B or C is fed the drying agent from another drying chamber is based upon the drying program being followed. The atmospheric conditions of the outside air can also be considered.

The first embodiment relates to a dryer with the drying chambers arranged lengthwise. The invention can also be used with drying chambers arranged in a transverse arrangement, wherein fans lie in a plane next to the drying chambers. Two connection passages are directly adjacent to the fans, and prevent or permit transfer of drying agent between the drying chambers. In transversely arranged drying chambers, the connection passages extend in the same manner between the fans. However, in drying chambers transversely arranged, the fan arrangement and the connection passages are pivoted 90° relative to a lengthwise arrangement drying chamber. The attachments of the connection passages in the individual drying chambers in the transverse arrangement are provided in transverse passages extending at a right angle to the drying chambers. Thus, the connection passages in a dryer with drying chambers arranged transversely can be arranged as in the graphic presentation of an electric rectangular wave pulse of a inverter.

The invention can also be used in a drying device with some other number of drying chambers.

The same parts are provided with the same references in the other embodiments of the present invention.

Figure 4:
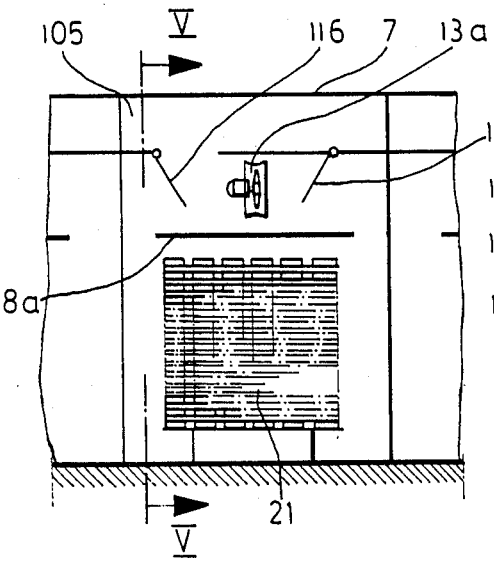
FIG. 4 is a diagrammatic front elevational view in section of a dryer according to a second embodiment of the present invention.
Figure 5:
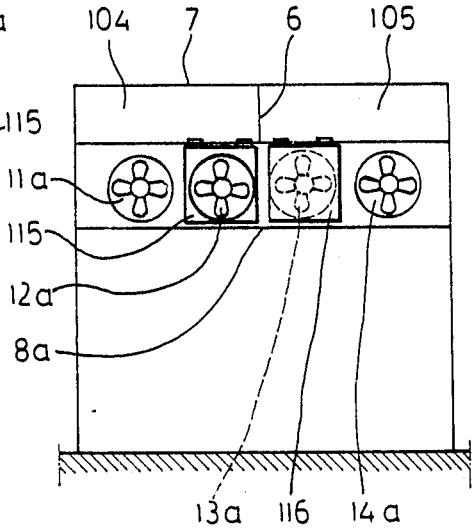
FIG. 5 is a diagrammatic side elevational view in section taken along line V—V of FIG. 4.

In the second embodiment of FIGS. 4 and 5, both connection passages 104 and 105 are arranged over fans 11*a* to 14*a*. The breadth or width of each connection passage extends over half the breadth or width of the drying chambers. Cover 7 of the drying chamber is also a wall on the top of passages 104 and 105. The top parts of the chamber side walls also form side walls of connection passages 104 and 105. These connection passages are separated from each other by a common vertical partition wall 6 extending parallel to the axes of fans 11*a* to 14*a*. Flaps 15 and 116, articulated on the bottom walls of connection passages 104 and 105, can be opened at the bottom. On account of their specific weight, flaps 115 and 116 are maintained in opened positions of their own accord. An intermediate ceiling 8 is provided beneath fans 12*a* to 14*a*. Flaps 115 and 116 are associated with fans 12*a* and 13*a*. A different arrangement is also possible, e.g. flaps 115 and 116 can be associated with fans 11*a* to 14*a*. Connection passages 104 and 105 can also be arranged at some lateral spacing from each other.

Figure 6:
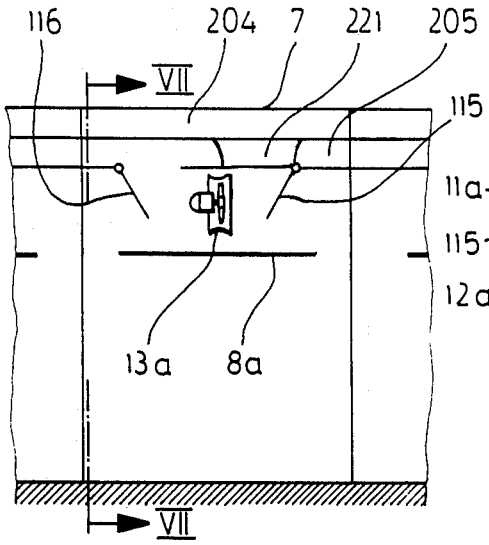
FIG. 6 is a diagrammatic side elevational view in section of a dryer according to a third embodiment of the present invention.
Figure 7:
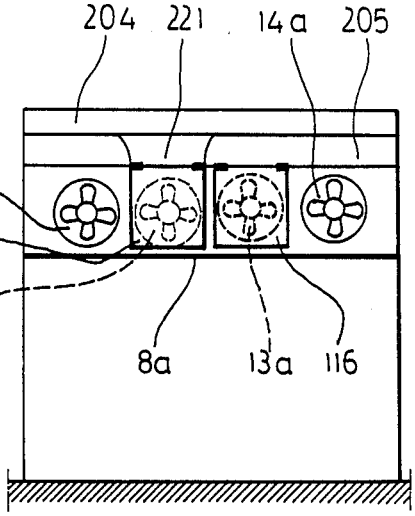
FIG. 7 is a diagrammatic front elevational view in section taken along line VII—VII of FIG. 6.

In the third embodiment of FIGS. 6 and 7, connection passages 204 and 205 are arranged directly one over the other. The top passage 204 has a connection 21 passing through lower passage 205. Connection 221 is associated with flap 115, which flap is articulated to or pivotally mounted on the bottom wall of connection passage 205. Flap 115 opens or closes an opening in connection 221. At the bottom wall of the bottom connection passage 205, a flap 116 opens or closes an opening in the bottom wall of connection passage 205. Cover 7 of the dryer is also the top wall of connection passage 204. The top parts of the chamber side walls also form the side walls of connection passages 204 and 205.

Figure 10:
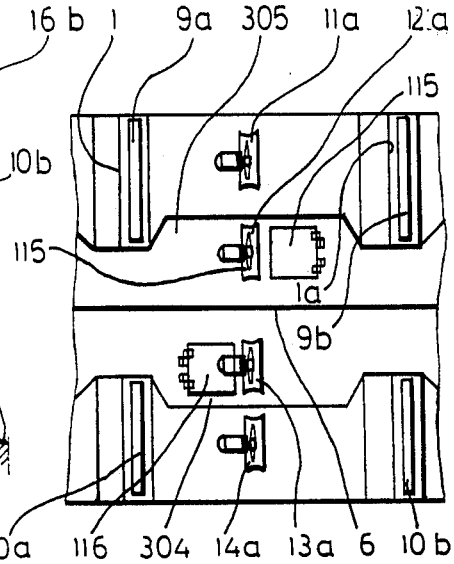
FIG. 10 is a diagrammatic top plan view in section taken along line X—X of FIG. 8.
Figure 8:
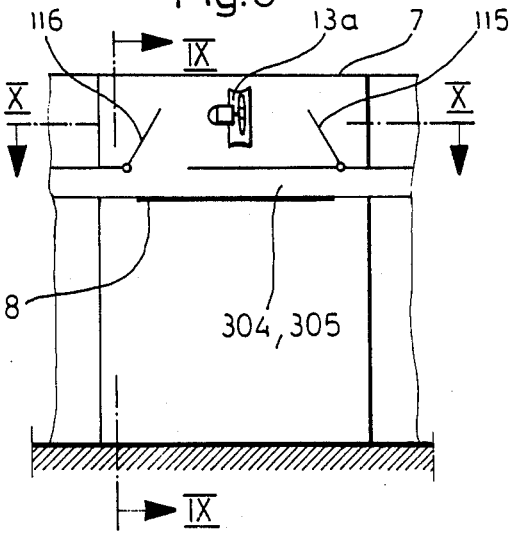
FIG. 8 is a diagrammatic side elevational view in section of a dryer according to a fourth embodiment of the present invention.
Figure 9:
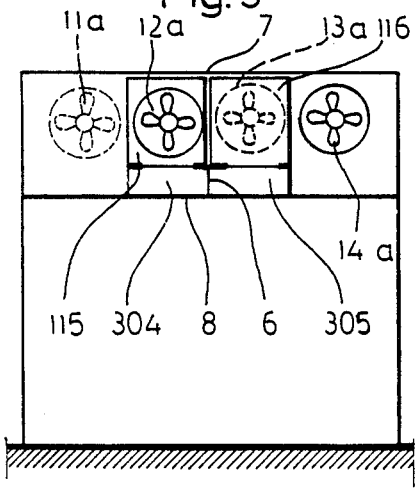
FIG. 9 is a diagrammatic front elevational view in section taken along line IX—IX of FIG. 8.

In the dryer of FIGS. 8 to 10, connection passages 304 and 305 are arranged beneath fans 11*a* to 14*a*. Intermediate ceiling 8 also forms the bottom wall of both connection passages 304 and 305. The connection passages are separated from each other by a common vertical intermediate partition 6. Flaps 115 and 116 are associated with fans 12*a* and 13*a* and are each articulated or pivoted to the top of the respective connection passage. The connection passages can also extend out horizontally, with the bottom connection passage having a connection extending upward corresponding to connection 221 (FIGS. 6 and 7). With the horizontal arrangement or layout of the connection passages, a connection passage can be arranged directly beneath cover 7.

Connection passages 304 and 305, having flaps 115 and 116 arranged beneath fans 11*a* and 14*a*, must be quite narrow in the area of the separation walls between individual drying chambers A, B, C or the outside walls of these chambers. The flaps must be narrower than those in the intermediate area, in order not to have too strong an effect on the circulation of the drying agent in the drying chamber. Connection passages 304 and 305 are tapered by approximately one-third to one-fourth their breadth in the middle of the drying chambers. This tapering is independent of the type of arrangement of intermediate partition between the connection passages.

The presently described embodiments are for lengthwise arrangements of drying chambers A, B, C parallel to the series of fans 11 to 14. The second exemplary embodiment of FIGS. 4 and 5 is for a transverse arrangement (i.e., transverse to the rows of fans arranged at a right angle to the fans of FIG. 1 and arranged in one plane), and is suitable when the intermediate partition 6 of the connection passages extends over all of the drying chambers A, B, C and is arranged perpendicular to the axes of the fans.

Figure 11:
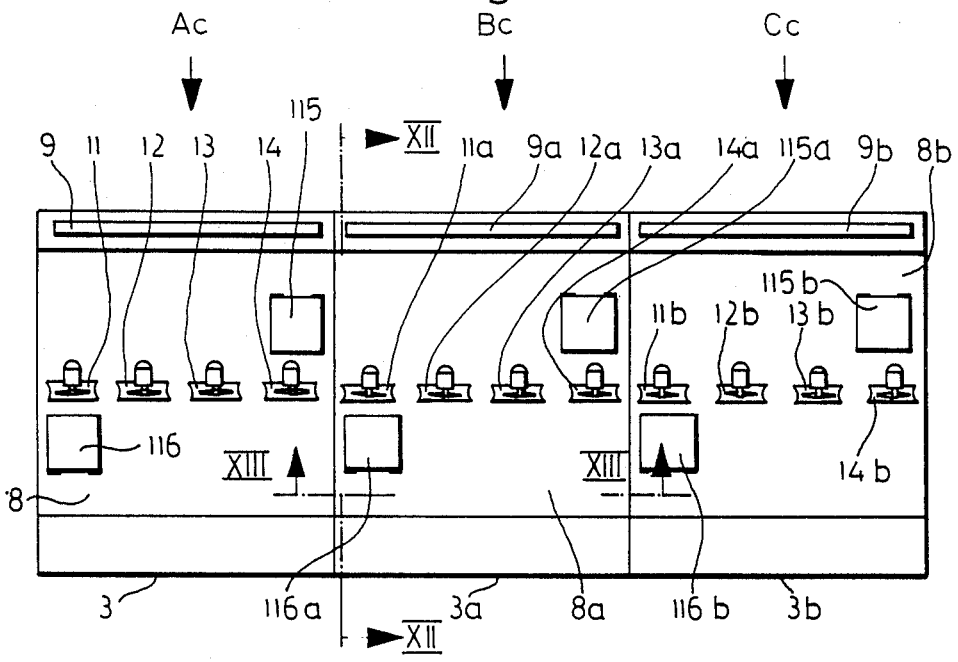
FIG. 11 is a diagrammatic top plan view in section of a dryer according to a fifth embodiment of the present invention, taken along line XI—XI of FIG. 12.
Figure 12:
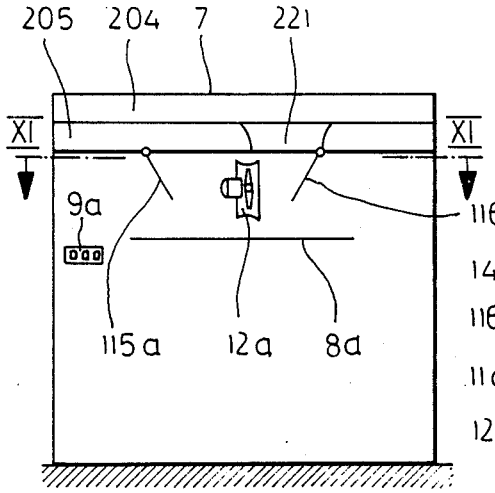
FIG. 12 is a diagrammatic front elevational view taken along line XII—XII of FIG. 11.
Figure 13:
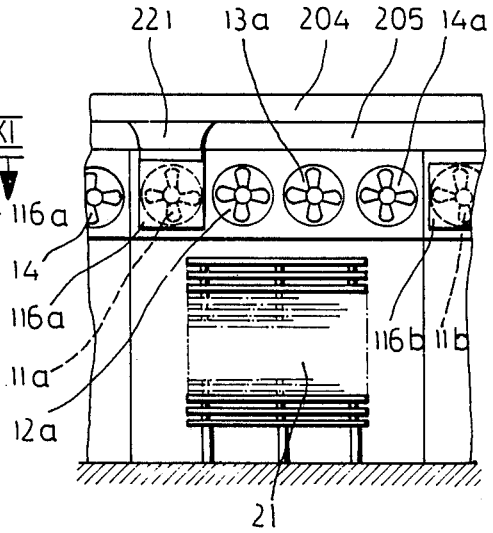
FIG. 13 is a diagrammatic side elevational view taken along line XIII—XIII of FIG. 11.

The arrangement of the connection passages 204 and 205 of the third embodiment of FIGS. 6 and 7 has a horizontal intermediate partition between the passages. It can also be provided in drying chambers of a transverse arrangement, as in FIGS. 11 to 13. The doors for the alignment of the drying chambers Ac, Bc and Cc, as in the other embodiments, are found at the side walls 3, 3*a*, 3*b* of the drying chambers. A stack of boards to be dried is shown in FIGS. 4 and 13.

The downward hanging flaps 115 and 116 of FIGS. 6 and 7 are pressed open by the dynamic pressure of the fans against a mechanical end stop. A clamping arrangement or a costly increase of the holding torque of the control motors for flaps 115 and 116 for holding the flaps open when the fans are in suction mode is not needed since the flaps, suspended from above, remain open as a result of their own specific weight.

With drying chambers in a transverse arrangement, at least one of the connection passages 204 and 205 can be arranged beneath fans 11*a* to 14*a*. If both connection passages are arranged beneath fans 11*a* to 14*a*, then the bottom connection passage must have a connection extending upward.

If the fourth embodiment of FIGS. 8–10 is configured for transverse arrangement, connection passages 305 and 306 need not be tapered and their total breadth can be the same as the breadth of the intermediate ceiling. For a transverse arrangement according to the fourth embodiment, the top wall of passages 304 and 305 can be corrugated and guide the drying agent. Flaps 116 and 115 then are adapted to the tops of passages 304, 305.

The embodiments of FIGS. 4 to 10 have flaps for the outside air and in the intermediate partition separating the connection passages, as in the first embodiment. The other appurtenances of the first embodiment can be applied to the drying chambers of the other embodiments.

Flaps 15 and 16 can have a width such that in their open positions they extend over more than one fan, especially over two or more fans. This provides the advantages of higher drying agent exchange, a higher moisture removal capacity by condensation, and improved thorough mixing of the drying agent in the drying chambers.

The intermediate partition separating the two connection passages can be of uneven configuration, especially corrugated. It can also run obliquely to the longitudinal or conveying direction of connection passages 15 and 16.

While various embodiments have been chosen to illustrate the invention, it will be understood by those skilled in the art that various changes and modifications can be made therein without departing from the scope of the invention as defined in the appended claims.

What is claimed is:

1. A dryer for wood chips with circulation fans, comprising:

first and second drying chambers separated by a partition wall;

first and second connection passages extending through said drying chambers for selective reciprocal fluid connection of said chambers, each of said passages having a port opening into each of said drying chambers, said connection passages being oriented over said fans, said first connection passage being located over said second connection passage, said connection passages, being separated by a common, horizontal partition, said first connection passage including connections extending vertically through said second passage to the ports thereof;

closure flaps associated with said ports and selectively movable between open positions spaced from said ports and closed positions closing said ports, each of said open positions being at an approximately 45° angle relative to the respective closed position;

said circulation fans being located in said drying chambers adjacent to said flaps such that said flaps in said open positions thereof deflect drying agent conveyed by said fans.

2. A dryer for wood chips with circulation fans, comprising:

first and second drying chambers separated by a partition wall;

first and second connection passages extending through said drying chambers for selective reciprocal fluid connection of said chambers, each of said passages having a port opening into each of said drying chambers, said connection passages being separated by a common partition, said common partition having, at least partially, a relatively enlarged surface area, said enlarged surface area having a portion of said common partition extending obliquely relative to longitudinal axes of said connection passages;

closure flaps associated with said ports and selectively movable between open positions spaced from said ports and closed positions closing said ports, each of said open positions being at an approximately 45° angle relative to the respective closed position;

said circulation fans being located in said drying chambers adjacent to said flaps such that said flaps in said open positions thereof deflect drying agent conveyed by said fans.

3. A dryer for wood chips with circulation fans, comprising:

first and second drying chambers separated by a partition wall and arranged in succession along a length of the dryer;

first and second connection passages extending through and across the entire width of said drying chambers for selective reciprocal fluid connection of said chambers, each of said passages having a portion opening into each of said drying chambers;

closure flaps associated with said ports and selectively moveable between open positions spaced from said ports and closed positions closing said ports, each of said open positions being at an approximately 45° angle relative to the respective closed position;

said circulation fans being located in said drying chambers adjacent to said flaps such that said flaps in said open positions thereof deflect drying agent conveyed by said fans.

* * * * *